US005100040A

United States Patent [19]

Kunreuther et al.

[11] Patent Number: 5,100,040

[45] Date of Patent: Mar. 31, 1992

[54] APPARATUS FOR SEPARATING LABELS FROM A PERFORATED SHEET

[75] Inventors: Steven Kunreuther, New York, N.Y.; John Pratt, Litchfield, Conn.

[73] Assignee: Texpak, Inc., Franklin Square, N.Y.

[21] Appl. No.: 759,845

[22] Filed: Sep. 13, 1991

Related U.S. Application Data

[63] Continuation of Ser. No. 397,242, Aug. 23, 1989, abandoned.

[51] Int. Cl.[5] ..... B26F 3/02; B65H 35/10

[52] U.S. Cl. ..... 225/105; 225/100

[58] Field of Search ..... 225/3, 100, 101, 97, 225/104, 105, 106

[56] References Cited

U.S. PATENT DOCUMENTS

| | | | |
|---|---|---|---|
| 1,553,277 | 9/1925 | Watts . | |
| 1,932,571 | 10/1933 | Blood . | |
| 2,171,769 | 9/1939 | Stolar et al. . | |
| 2,237,320 | 4/1941 | Spayd et al. . | |
| 2,246,228 | 6/1941 | Winter . | |
| 2,311,692 | 2/1943 | Potdevin . | |
| 2,331,351 | 10/1943 | Seeley | 225/105 |
| 2,639,772 | 5/1953 | Andberg et al. | 225/97 |
| 3,146,927 | 9/1964 | Peterson . | |
| 3,224,311 | 12/1965 | Wagner . | |
| 3,357,616 | 12/1967 | Bangert . | |
| 3,493,156 | 2/1970 | Absler et al. . | |
| 3,626,561 | 12/1971 | Luce et al. . | |
| 3,628,710 | 12/1971 | Mannheim et al. | 225/3 |
| 3,658,220 | 4/1972 | Norton | 225/3 |
| 3,670,939 | 6/1972 | Mueller, Jr. | 225/100 |
| 3,739,667 | 6/1973 | Ernst . | |
| 3,741,451 | 6/1973 | Parenti et al. . | |
| 3,768,712 | 10/1973 | Imbert . | |
| 3,794,228 | 2/1974 | Colwill et al. | 225/101 |
| 3,843,318 | 11/1974 | Parenti et al. . | |
| 3,863,821 | 2/1975 | Van Bennekom | 225/101 |
| 3,870,213 | 3/1975 | Meylan . | |
| 4,065,990 | 1/1978 | Edhlund | 83/133 |
| 4,454,973 | 6/1984 | Irvine . | |
| 4,529,114 | 7/1985 | Sasper et al. . | |
| 4,618,085 | 10/1986 | Kimura et al. . | |

FOREIGN PATENT DOCUMENTS

| | | | |
|---|---|---|---|
| 144182 | 11/1981 | Japan | 225/105 |
| 745673 | 7/1980 | U.S.S.R. | 225/3 |
| 648941 | 1/1951 | United Kingdom | 225/105 |

*Primary Examiner*—Hien H. Phan
*Attorney, Agent, or Firm*—James & Franklin

[57] ABSTRACT

Labels in sheet form are first separated into strips along spaced parallel perforation lines extending in the direction of sheet movement and then into individual labels along spaced perforation lines extending in a direction transverse to sheet movement. The strip separation step can be accomplished with one of three ways. The first embodiment includes a two driven pressure rollers one of which has a resilient exterior surface including discontinuous alternating larger and smaller diameter areas and the other has a rigid continuous surface of different diameter sections. The rollers cooperate to clamp the sheet at points between the perforation lines as it moves and exert to a force along the perforating lines to burst same. The second embodiment involves moving belts which clamp the sheets between the perforation lines as it moves, gradually separating into different planes. The third embodiment includes a reciprocating element with fins and a pressure pad with slots aligned with the perforation lines to accomodate the reciprocating fins. Transverse separation is accomplished by first and second spaced pairs of rollers. The second pair of rollers is rotated at a higher speed than the first pair such that the labels are completely separated. The individual labels can be accumulated on a slowly moving conveyor.

7 Claims, 5 Drawing Sheets

FIG. 4
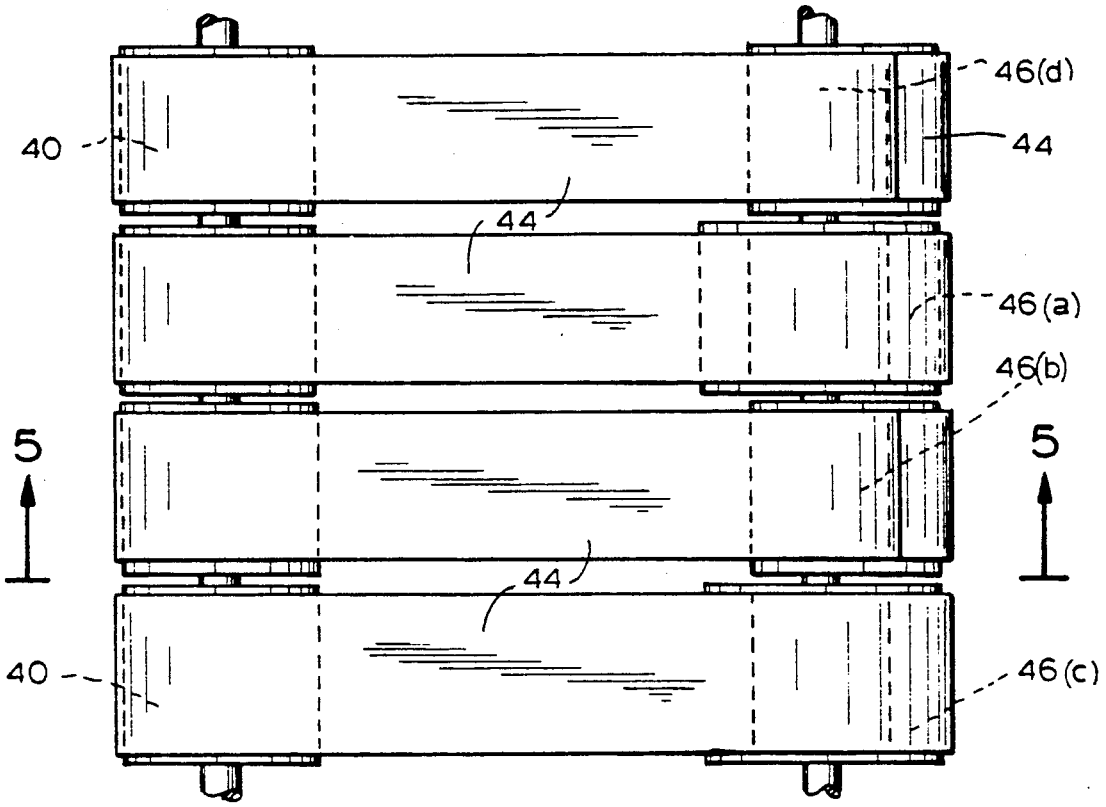
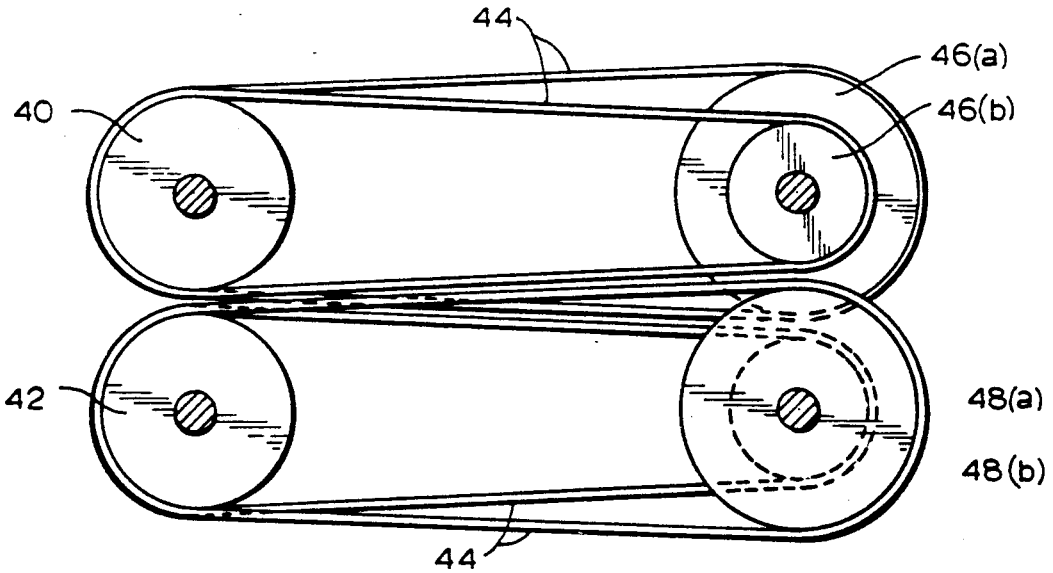
FIG. 5

APPARATUS FOR SEPARATING LABELS FROM A PERFORATED SHEET

This is a continuation of co-pending application Ser. No. 397,242 filed on Aug. 23, 1989 now abandoned.

This present invention relates to apparatus for separating labels from a perforated sheet and, more particularly, to apparatus for separating labels from a continuous sheet perforated in substantially orthogonal directions.

Every garment sold in the United States is required to have a label which contains the washing instructions. In many cases, the manufacturer will put additional information on the label such as the style number, size, fiber content and the like. In order to create such labels, many garment manufacturers have a machine which prints the information on the labels. The leading manufacturer of such equipment is the Soabar Mfg. Company, a division of Avery Products Corporation of Philadelphia, Pa.

Until relatively recently, these label printing machines operated with set type. The operator of the machine had a case of type and would pick out the particular letters to set up the information. Alternatively, blocks of information could be preprinted on a rubber mat similar to those used on rubber stamps and attached to the unit. Machines of this type commonly have counters and can be set to produce 50 or 100 or whatever number of labels is required.

Blank labels are fed into such machines in a strip, one label wide. The labels are printed on the strip consecutively. The machines are available with two output options. The first option is to coil the printed strip into a roll of finished labels. The second option is to cut the strip into individual labels.

Apparel manufacturers take the finished labels and sew them into garments. In some cases, particularly where the items are sent to contractors or other manufacturers for labeling or stored for future use, it is desirable to have the printed labels in roll form. In other cases, where operators want to move more quickly, it is desirable to have the labels cut individually.

The recent introduction of computerized label printers into the market has offered increased versatility in the printing of labels. Several computerized machines, such as those developed by Compute-A-Label, Inc. of Los Angeles, Calif. and Photomarker Corp. of Bronx. N.Y. are available. The machines include a customized micro-computer and a printer. A sheet of orthogonally perforated cloth or heavy paper material, with sprocketed edges, is fed into the machine. The operator uses a keyboard to input the required information, that is, the number of labels to be printed and the information to be printed on each. The labels are printed and exit the machine in a continuous sheet, several labels wide.

Such computerized label printing machines have proven to be extremely efficient and are in high demand by apparel manufacturers throughout the country. A major disadvantage of such units is that the finished labels come out in sheets and hence not in a form which is easy to use by the apparel manufacturer, that is, not in a stack of individual labels or even a strip of labels in a roll. Thus, prior to use, the apparel manufacturer must manually rip the labels apart along the orthogonal perforations, in very much the same way that postage stamps are separated. To accomplish this, the labels are folded horizontally and vertically in order to weaken the lines of perforation. This is a time consuming, labor intensive process and significantly reduces the potential for the computerized label printing.

The present invention is an apparatus for automatically separating useable members, such as labels, from a continuous orthogonally perforated sheet of the type which is generated by computerized label printing machines. It is designed for use in conjunction with such a printing machine, either to operate directly on the continuous sheet of printed labels as it exits the machine or separately at a later time, to separate the labels, either into strips, or, preferably, into stacks of individual labels.

In general, the apparatus of the present invention includes a first means adapted to separate strips of connected labels along lines of perforation extending in the direction of sheet movement through the apparatus, that is, longitudinally. The continuous strips of labels can thereafter be rolled, if desired. However, in the preferred embodiment, the continuous strips are transferred to a second means adapted to separate the continuous strips into individual labels. Means are provided to accumulate the individual labels. The second means preferably comprises first and second spaced sets of driven rollers. The second set rollers rotates at a speed greater than the first set, so as to separate rows of labels along lines of perforation extending transverse to the direction of sheet movement.

As far as applicants are aware, there is no machine available which is capable of automatically separating useable cloth or paper members formed in a continuous sheet along orthogonal perforation lines. U.S. Pat. No. 2,171,769 to Stolar discloses a machine which is capable of separating the sprocketed edge portions of computer sheets from the sheets themselves, such that same can be discarded. However, that machine is capable of separating along perforation lines which extend in only a single direction. Moreover, it is only capable of separating the discardable peripheral portions of the sheet from the useable portion thereof. It does not and cannot separate useable members from each other along orthogonal perforation lines when the members form a sheet.

In addition, the Stolar machine utilizes rotating knife blades to achieve separation. The blades must accurately register with the perforation lines to function properly. The use of knife blades, especially moving blades, creates problems. Such blades have a short useful life. They tend to dull quickly and must be resharpened or replaced frequently. Further, rapidly rotating knives are dangerous because they have the capability of causing serious injury.

We have, instead adapted a different approach which does not utilize sharp blades to cut the sheets along the lines of perforation but instead simply applies pressure proximate the lines of perforation to "burst" same. This approach not only eliminates the need for dangerous knives with short useful lives, it also greatly reduces registration problems.

In our apparatus, the sheets are first separated into strips and then the strips are separated into individual labels. Three different embodiments of the strip separating means could be employed. In each embodiment, means are provided for clamping adjacent strips of labels along their central portions. Means are also provided for exerting a force on the sheet, proximate the lines of perforation defining the strips, to separate the strips.

In a first preferred embodiment, separation is accomplished through the use of a pair of driven pressure rollers, each having a particular surface contour and rigidity. The roller surface counters cooperate to clamp the mid portions of the strips and to exert a force proximate the line of perforations, to burst the perforations. This structure completely eliminates the need for knife blades or other sharp cutting surfaces, as well as extremely accurate registration.

We are aware of equipment utilizing pairs of rotating rigid elements to effect separation, such as disclosed in U.S. Pat. No. 2,237,320 to Spayd. However, the rollers which are utilized for separation in my machine have a different contour, cooperate in a different manner and have substantially different relative surface rigidities, as compared to those disclosed in the Spayd patent.

In a second preferred embodiment of the strip separating means, pairs of driven parallel belts, a different pair aligned with each strip, are adapted to clamp same as the sheet is moved longitudinally through the machine. At the point where the sheet enter between the belts, adjacent belts are in the same plane. However, as the sheet progresses through the machine, the belts gradually move into in different planes, causing the sheet to tear along the perforations. Again no knives are used and registration problems are reduced.

In the most preferred embodiment, the strip separating means includes a platen located below the sheet. The platen has elongated recesses aligned with the perforations between adjacent strips. A pressure plate, with slots aligned with the recesses, is located above the sheet and moveable to clamp the sheet between it and the platen. An element, including parallel fins aligned with the slots in the plate, is moved perpendicular to the surface of the sheet such that the fins move through the slots and exert forces proximate the perforations.

Once the sheet is separated into strips of labels, the strips can be rolled and removed for later use. However, in its preferred form, the apparatus of the present invention includes a means for separating the strips into individual labels. The means includes first and second spaced pairs of pressure rollers. The second pair is driven faster than the first to separate the strips transversely. The labels may then be accumulated on a slowly moving conveyor.

It is, therefore, a prime object of the present invention to provide apparatus for automatically separating useable members such as labels from a continuous sheet wherein the members are defined by orthogonal perforation lines.

It is another object of the present invention to provide an apparatus to automatically separate labels from a perforated sheet which is design for use in conjunction with computer controlled printing equipment.

It is another object of the present invention to provide apparatus for automatically separating labels form a perforated sheet which includes first means for separating the sheet into strips and second means for separating the strips into individual labels.

It is another object of the present invention to provide apparatus for automatically separating labels from a perforated sheet which does not require knives, blades or sharp, dangerous edges.

It is another object of the present invention to provide apparatus for automatically separating labels from a perforated sheet wherein problems of registration are greatly reduced.

It is another object of the present invention to provide apparatus for automatically separating labels from a perforated sheet wherein the strip separating means includes means for clamping adjacent strips and means for exerting a force proximate the perforations.

It is another object of the present invention to provide an apparatus for automatically separating labels from a perforated sheet in which the transverse separating means includes first and second spaced pairs of pressure rollers, where the second pair is driven at a speed higher than the first pair to separate the individual labels along transverse lines of perforation.

To these and such other objects which may hereinafter appear, the present invention relates to apparatus for automatically separating labels from a perforated sheet, as described in detail in the following specification and recited in the annexed claims, taken together with the accompanying drawings where in like numerals refer to like parts, and in which:

FIG. 4 is a top elevational view of a second preferred embodiment of the strip separating means;

FIG. 5 is a side view of the embodiment of the strip separating means illustrated in FIG. 4;

Figure 1:
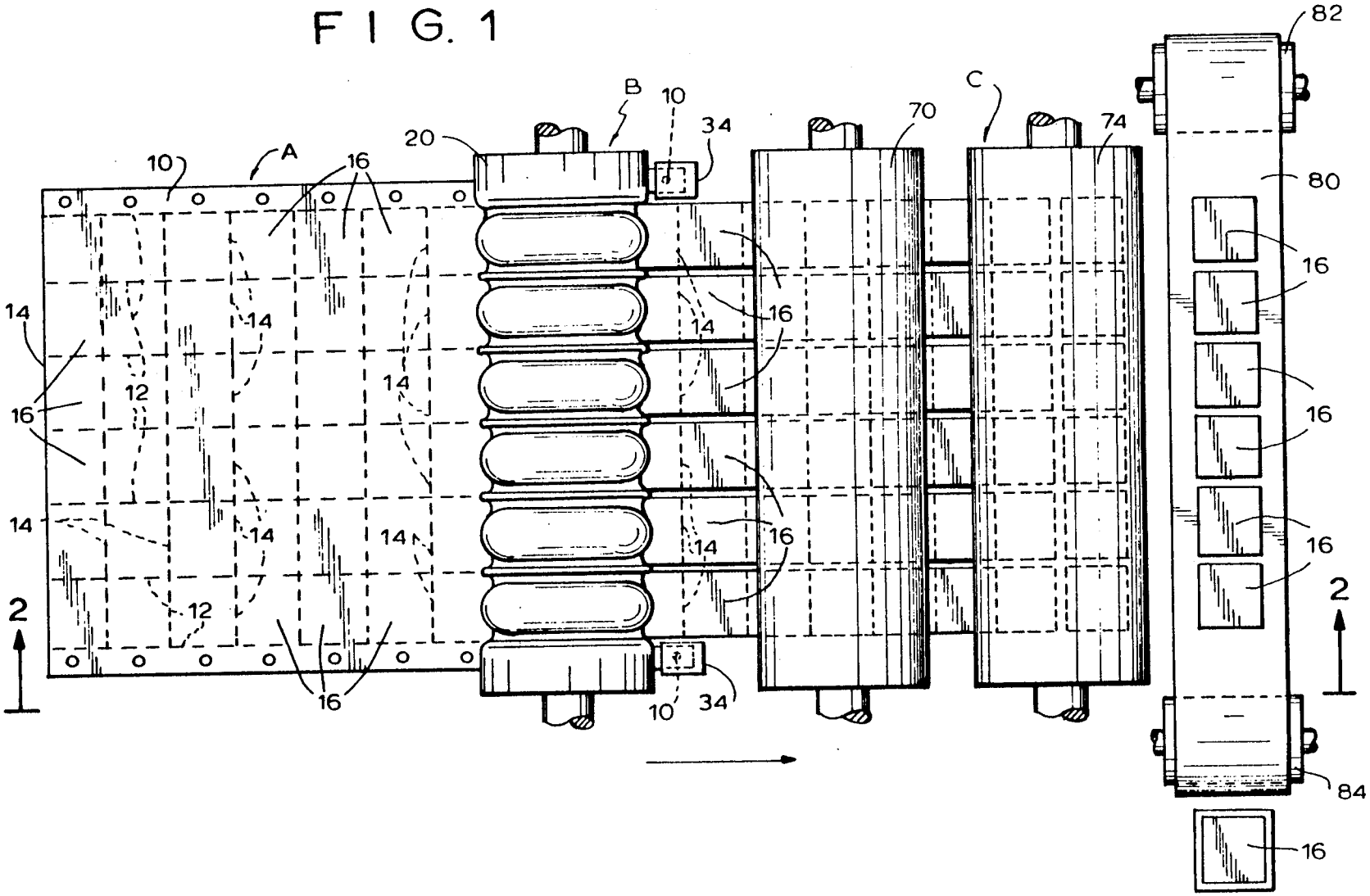
FIG. 1 is a top elevational view of the apparatus of the present invention, showing a first preferred embodiment of the strip separating means and the transverse separating means.
Figure 2:
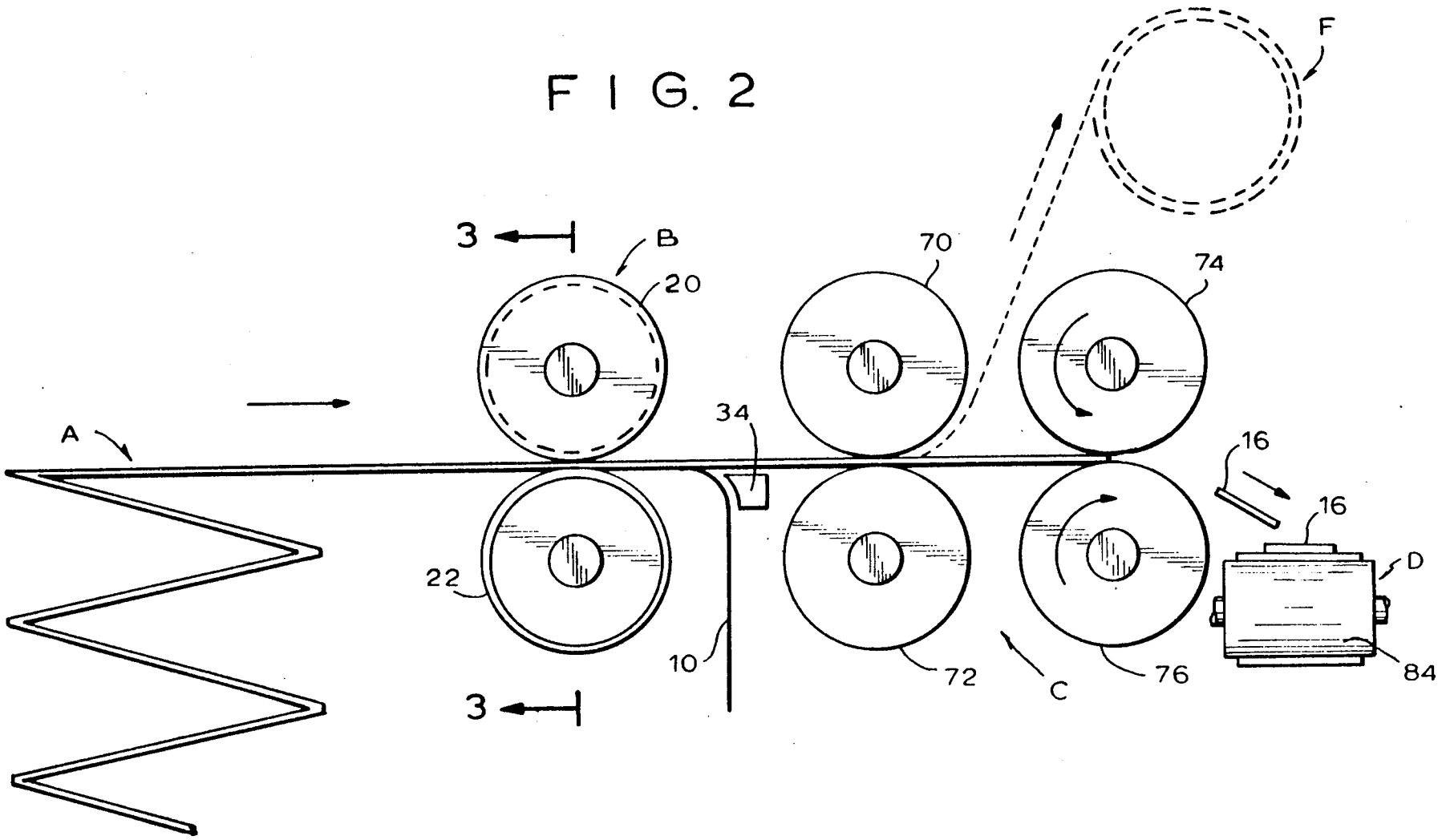
FIG. 2 is a side view taken along line 2—2 of FIG. 1 showing the optional strip rolling means.

As illustrated in FIGS. 1 and 2, the present invention relates to an apparatus for automatically separating labels from a perforated sheet, generally designated A, which may be taken directly from the output of the computerized labelling machine. Sheet A may be provided in roll form or in a stack, as shown in FIGS. 1 and 2, which has a zig zag appearance an end view, as shown in FIG. 2.

As can best be seen in FIG. 1, the continuous sheet a typically includes sprocketed edge portions 10, a plurality of spaced, substantially parallel perforation lines 12 which extend in the direction of sheet movement through the machine (as indicated by the arrow) and a plurality of spaced substantially parallel perforation lines 14 which extend laterally or transverse to the direction of sheet movement and substantially orthogonally with respect to perforation lines 12. Continuous sheet A is generally composed of relatively rigid paper or thin cloth material. Each individual label 16 is generally rectangular and defined between two sets of spaced parallel perforation of lines 12, 14. The apparatus separates the sheets into strips, automatically removes the sprocketed edge strips 10, separates the strips into individual labels 16 and accumulates the labels.

Upon entering the apparatus, sheet A passes through a strip separating means, generally designated B, where perforation lines 12 are burst to separate sheet A into strips. After sheet A has been separated into strips and the peripheral edge portions 10 removed, the strips move into a transverse separating means, generally designated C, which serves to separate the strips into individual labels by bursting perforation lines 14. The individual labels 16 are then accumulated on a collecting means, generally designated D, such as a slowly moving conveyor or the like.

As is schematically depicted in FIG. 2, a portion of the transverse separating means C can be bypassed, if desired, such that the strips exit the apparatus intact and are collected in rolls on a driven spool or the like, generally designated F. Strip collection means F is provided as an option and this portion of the apparatus has not been illustrated in FIG. 1 because it obscures other portions of the apparatus.

Strip separating means B can take the form of any one of the three preferred embodiments which are disclosed herein. In each of the three embodiments, two separate functions are performed. First, the sheet is clamped along lines between perforation lines 12 and most preferably proximate the mid portion of each strip. After the strips are clamped proximate their mid-portions, a force is exerted proximate the perforation lines 12 to burst same in order to separate the sheet into strips. In each case, the clamping function and force the exerting function are performed by different structures.

Figure 3:
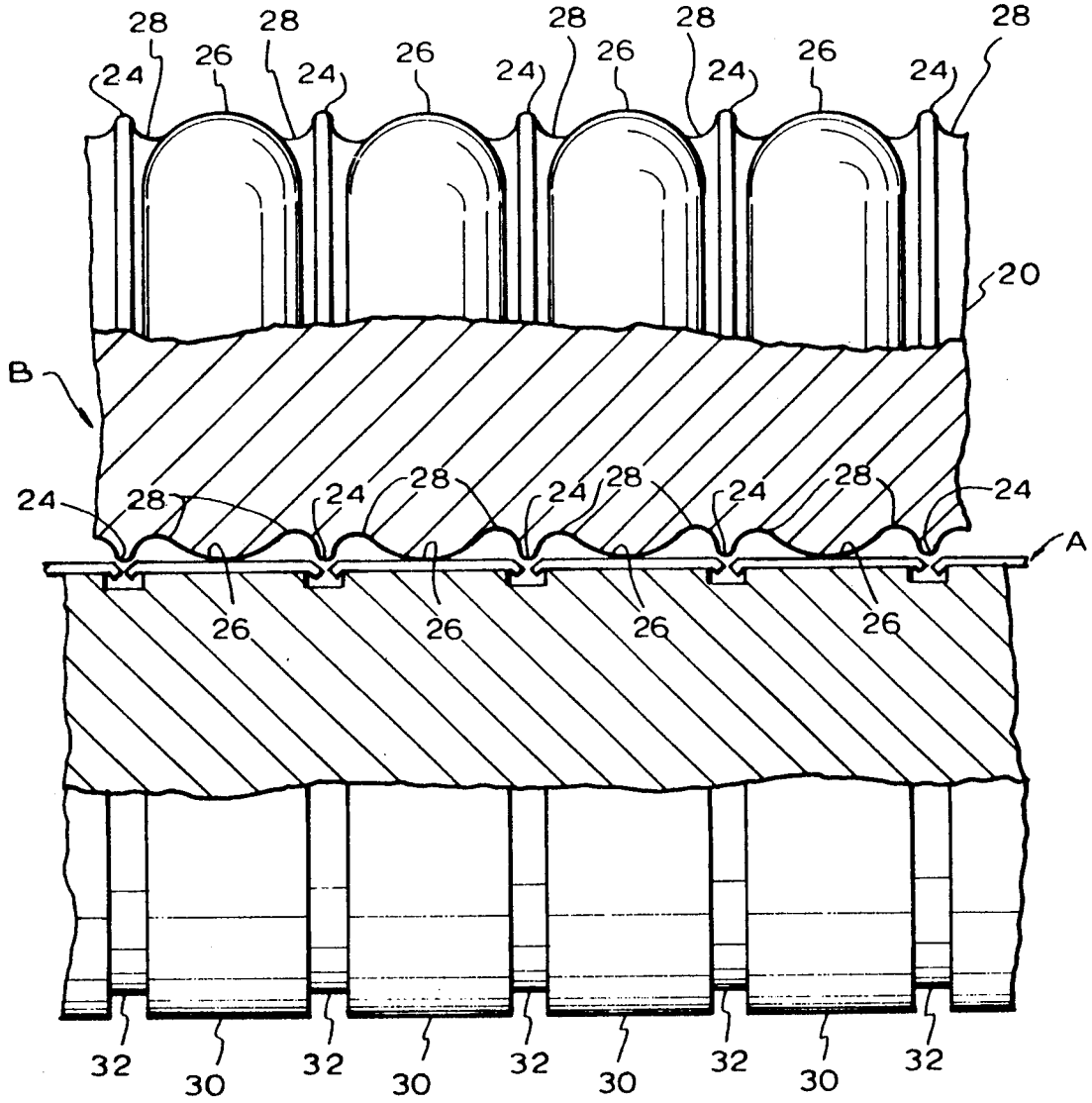
FIG. 3 is an enlarged front, partially cross sectional view, of a portion of the surfaces of the rollers in the first preferred embodiment of the strip separating means.

In the first preferred embodiment of strip separating means B, as illustrated in FIGS. 1, 2 and 3, a pair of pressure rollers 20 and 22 are employed. Roller 20 is situated above sheet A and roller 22 is situated below sheet A. Either one or both of rollers 20, 22 are driven by conventional means, not shown. It is the contour of the exterior surfaces of rollers 20 and 22, and the manner in which same cooperate, which performs the clamping and force exerting functions.

As best seen in FIG. 3, in which each of the rollers 20 and 22 is shown in plan and cross sectional view, roller 20 is a metal roller with a rigid exterior surface and roller 22 is a rubber roller with a relatively soft, resilient exterior surface. The top portion of each roller illustrated in FIG. 3 shows exterior surface of the roller whereas the bottom portion shows the roller in cross section.

The exterior surface of roller 20 is continuous and divided into sections defined by relatively narrow areas of relatively large diameter 24 which are situated substantially in alignment with perforation lines 12. Approximately midway between adjacent sections 24 are situated relatively wide portions 26 which have relatively larger outer diameters, slightly larger than that of section 24. Sections 26 align with the mid-portions of the label strips. Between each section 24 and its adjacent section 26 is situated a section 28 with a relatively smaller diameter. Hence, the exterior surface of roller 20 is rigid and consists of a series of alternating hills and valleys of the appropriate size and diameter.

Roller 22, on the other hand, has a discontinuous exterior surface of soft rubber. It includes areas 30 of relatively large diameter and slightly narrower than the width of the strips and areas 32 of relatively smaller diameter which align with sections 24 of roller 20 and hence perforation lines 12.

Sections 26 of roller 20 and areas 30 of roller 22 serve to clamp the strips firmly therebetween, proximate the mid-portions of the strips, so as to prevent any lateral movement thereof. As the rollers press towards each other with strip A therebetween, the relatively flexible sheet will tend to adapt the contours of the rigid surface of roller 20. Because the distance between adjacent sections 24 on roller 20, measured along the contour of the surface, is longer than the distance between adjacent perforation lines 12, as sheet A adapts the shape of the contour, a considerable amount of bursting force is applied along the perforation lines 12 by sections 24. This causes the lines 12 to burst, thereby separating the sheet into parallel strips.

By the same process, the peripheral edge portions 10 are separated from the useable portion of sheet A and removed from the machine by plows 34 located between the strip separating means B and the transverse separating means C. As shown in FIG. 2, peripheral edge strips 10 are simply diverted downwardly by plows 34 and collected in a waste receptacle or the like (not shown).

FIGS. 4 and 5 illustrate the second preferred embodiment of the strip separating means B. This embodiment of the strip separating means comprises a first set of driven rollers 40, 42 situated above and below sheet A, respectively, so as to clamp sheet A therebetween. The surfaces of rollers 40 and 42 are preferably relatively rigid.

Rollers 40 and 42 each have substantially uniform diameters. Situated along each of the rollers 40 and 42 are plurality of parallel endless belts 44 which are in aligned pairs, one belt in each pair being associated with the upper roller 40 and one belt in each pair being associated with lower roller 42. As sheet A enters between rollers 40 and 42 the aligned belts 44 serve to clamp the sheet approximately midway between each pair of perforation lines 12. Downstream from rollers 40 and 42 are a second pair of aligned rollers 46 and 48. Roller 46 consists of alternating relatively larger diameter segments **46*a* and relatively smaller diameter segments 46*b*. Similarly, roller 48 consists of relatively larger diameter segments 48*a* and relatively smaller diameter segments 48*b*. The larger diameter segments 46*a* of roller 46 align with the smaller diameter segments 48*b* on roller 48. The larger diameter segments 48*a* on roller 48 align with the smaller diameter segment 46*b* on roller 46. The belts which are associated with roller 40 at one end are associated with segments 46*a* and 46*b* on roller 46 on the other end. For example, even numbered belts 44 associated with roller 40 are associated with segments 46*a*, whereas odd numbered belts 44 are associated with segments 46*b*. Similarly, even numbered belts 44 associated with roller 42 at one end are associated with segments 48*b*, whereas odd numbered belts are associated with segments 48*a*** at the other end.

The above structure results in aligned pairs of moving belts 44 which clamp the strips therebetween. The adjacent portions of the aligned pairs of belts 44 all start off in the same plane but as the belts travel downstream, adjacent ones of the aligned pairs gradually move into different planes. This causes the perforation lines 12 to tear or burst. Alternate strips, thus formed, will exit this embodiment of the strip separating means between rollers 46 and 48 in slightly different planes and are then brought back into the same plane as they move into the transverse separating means C.

As will now be appreciated, in the second preferred embodiment of strip generating means B, aligned belts serve to clamp the sheet along the strips. As the adjacent clamped portions of the sheet gradually move to different vertical planes or levels, a force is exerted along perforation lines 12 to burst same, forming the separate strips.

Figure 6:
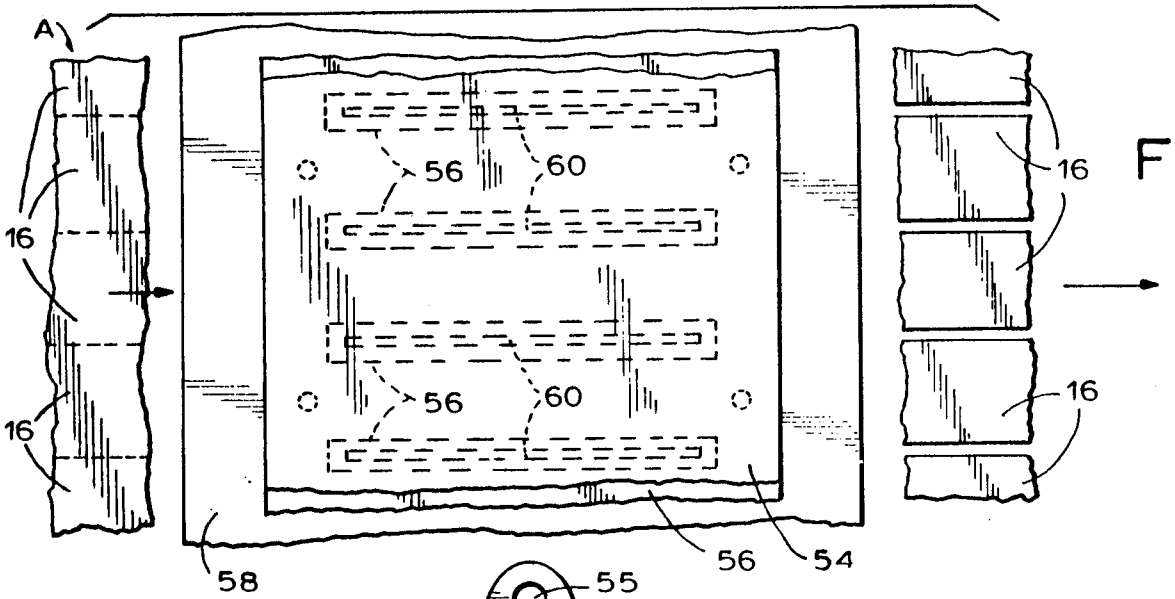
FIG. 6 is a top elevational view of a third preferred embodiment of the strip separating means.
Figure 8:
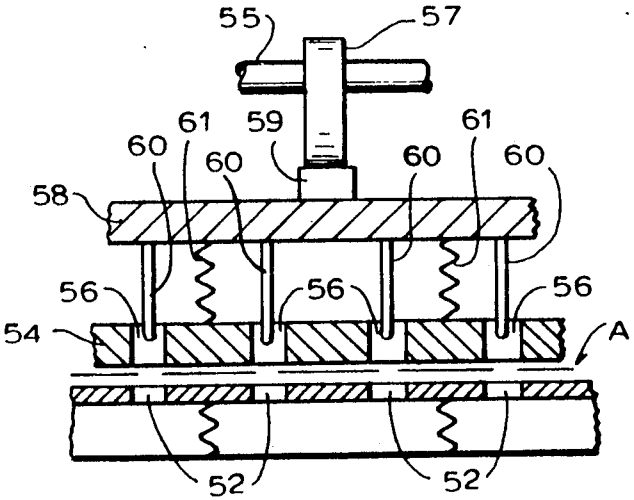
FIG. 8 is a front elevational view of the third preferred embodiment of the strip separating means.
Figure 7:
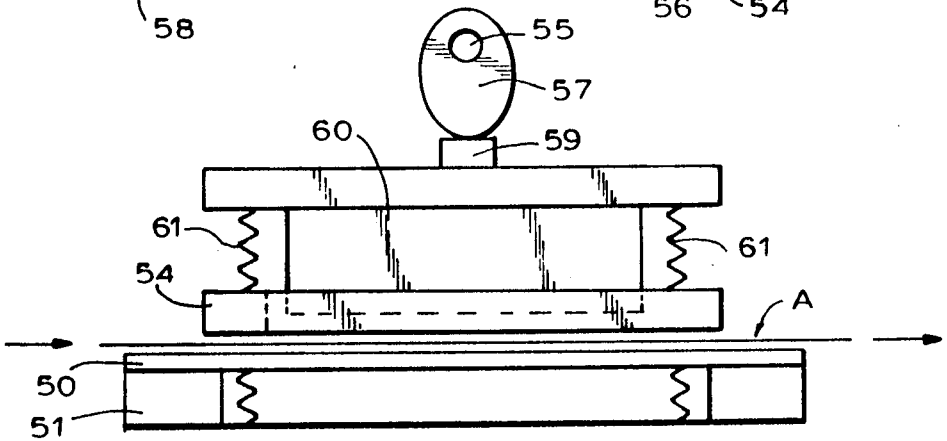
FIG. 7 is a side elevational view of the third preferred embodiment of the strip separating means.

The third preferred embodiment of the present invention is disclosed in FIGS. 6, 7 and 8. As seen in these figures, a platen 50 is situated below sheet A. Platen 50 is provided with a plurality of elongated recesses 52 which are considerably wider than but generally aligned with perforation lines 12 on sheet A. As sheet A travels over plate 50, the forward movement thereof is momentarily stopped and a pressure plate 54 is pushed down over the sheet, clamping the sheet between plate 54 and the upper surface of platen 50. Pressure plate 54 has a plurality of elongated slots 56 therein which align with the recesses 52 on platen 50. Above pressure plate 54 is an element 58 which has a plurality of generally parallel, spaced fin-like members 60 which aligned with slots 56. Elements 58 is moved vertically downwardly, towards platen 50 such that fins 60 pass through slots 56 and into recesses 58, thereby exerting sufficient force proximate perforation lines 12 to burst same.

As shown schematically in the drawings, it is preferable to spring mount platen to a base 51 or the like to permit limited movement thereof such that at least a portion of the force from pressure plate 54 can absorbed as the pressure plate 54 is reciprocated towards platen 50.

Preferably, the movements of plate 54 and element 56 are controlled in a conventional manner by a rotating cam shaft 55 carrying a cam 57. A cam follower 59 is connected to element 58. Rotating cam shaft 55 is driven in unison with the rollers of transverse separating means B such that the sheet A moves through the apparatus intermittently.

Element 58 is attached to pressure plate 54 by a series of springs 61 so that platen 54 and element 58 reciprocate together. However, the vertical distance over which platen 54 moves is less than the vertical distance over which element 58 moves.

After fins 60 have separated the strips along perforations 12, over a given length in the direction of the sheet movement, for example 8 inches, pressure plate 56 and element 58 move upwardly to release strip A, which can now progress through the apparatus an additional length. Thereafter the motion of the continuous strip A is again stopped and pressure plate 56 and element 58 are reciprocated to burst the next section of the perforation lines 12.

Referring again to FIGS. 1 and 2, after sheet A exits the strip separating means B it enters into the first portion of the transverse separating means C which consists of a pair of driven pressure rollers 70, 72. Rollers 70, 72 have substantially uniform, relatively rigid rubber exterior surfaces. They serve to pinch the separated strips therebetween. One or both of rollers 70, 72 are driven at a given speed, by conventional drive means. Spaced from rollers 70, 72 and downstream thereof, are a second pair of rollers 74, 76 which form the second section of the transverse separating means C.

If the labels are to be collected in strips, they are taken directly from between rollers 70 and 72, at this point, pass over roller 74 and into the strip collection means F, as illustrated in phantom in FIG. 2. However, assuming that the strips are to be separated into individual labels, the strips will pass from rollers 70, 72 to the second set of rollers 74, 76.

One more of the rollers 74, 76 is driven. The speed of the second pair of rollers 74, 76 is somewhat greater than the speed of the first pair of rollers 70, 72 such that the strips of labels are separated transversely, along perforation lines 14. The individual labels 16 exit the second pair of rollers 74, 76 and are accumulated on a conveyor belt 80 which moves between a pair of powered rollers 82 and 84 in a direction which is transverse to the direction of movement of sheet A through the apparatus. The labels may be collected in a stack or like at the end of belt 80. Alternatively, a slowly moving conveyor belt extending away from rollers 74,76 but in the same direction the sheet movement may be utilized.

It will now appreciated that the present invention relates to apparatus for automatically separating labels from a perforated sheet in which labels in the sheet are first separated into strips, along spaced, parallel perforation lines extending in the direction of sheet movement, and then into individual labels, along spaced perforation lines extending in a direction transverse to sheet movement. The strip separation can be accomplished in one of three ways. In the first preferred embodiment, a roller having a resilient exterior surface divided into discontinuous alternating larger and smaller diameter areas and a roller with a rigid exterior having a continuous surface of different diameter sections cooperate to clamp the sheet at points between the perforation lines and exert a force along the perforation lines. The second embodiment involves moving belts which clamp the sheet between the perforation lines and gradually separate into different planes. The third embodiment includes a reciprocating element with fin-like members which cooperate with a slotted pressure pad. The fins and slots are aligned with the perforation lines. The transverse separation means utilizes first and second spaced pairs of rollers. The second pair of rollers is rotated at a high speed than the first pair, such that labels are completely separated. The individual labels can then be accumulated on a slowly moving conveyor.

In none of the embodiments of the strip separating means are sharp edges of knife blades of any type used. Accordingly, there is no opportunity for such edges of blades to dull and require replacement. Moreover, the safety of the operator of the machine is greatly enhanced without such sharp edges or blades. Further, it should be appreciated that in none of the three embodiments is registration with the perforation lines critical. Thus, the forces exerted on the perforation lines need not be exerted exactly on the perforation lines but can be exerted anywhere proximate thereto, in order to achieve the required result. Hence, not only is the machine safe, the necessity for precise force application on the perforation lines is eliminated and thus most of the registration problems usually found in high speed machines are eliminated.

While only a limited number of preferred embodiments had been disclosed for purpose of illustration, is obvious that many variations and modifications could be made thereto. It is intended to cover all of the variations and modifications which fall within the scope of the invention as defined by the following claims.

We claim:

1. Apparatus for separating individual labels from a continuous sheet, the labels being defined, in part, by a first set of spaced, parallel perforation lines extending in a given direction on the sheet, the apparatus comprising a support having a substantially planar surface, means for moving the sheet over said support surface in the given direction, and means for separating the sheet into strips of labels along the perforation lines of said first set, said separating means comprising: a pressure plate comprising a substantially planar surface substantially parallel to and aligned with said support surface, said plate surface having a forward edge and a rearward edge, a plurality of spaced, substantially parallel slots in said plate surface, each of said slots extending substantially in the given direction and being aligned with a different one of said perforation lines of said first set, each of said slots having a front end and a back end, said front ends of said slots being spaced from said forward edge of said plate surface and said back ends of said slots being spaced from said rear edge of said plate surface, an element located above said pressure plate, said element comprising a plurality of spaced, substantially parallel downwardly extending elongated members, each of said members aligning with a different one of said slots, means for moving said pressure plate between a position where said plate surface is spaced from said support surface and a position where said plate surface is proximate said support surface and clamps a section of the sheet therebetween and for moving said element relative to said plate, to cause said members to pass through said slots and burst the aligned perforation lines of the clamped sheet section.

2. The apparatus of claim 1 further comprising a plurality of recesses in said support surface, each of said recesses aligned with a different one of said members.

3. The apparatus of claim 1 further comprising spring means operably connecting said element and said pressure plate.

4. The apparatus of claim 1 wherein said pressure plate moving means comprises a rotating shaft and an eccentric cam mounted on said shaft, said cam being in operative engagement with said element.

5. The apparatus of claim 1 wherein the labels are further defined by a second set of spaced parallel perforation lines on the sheet, the apparatus further comprising means for separating the labels along said second set of perforation lines.

6. The apparatus of claim 5 wherein said means for separating the labels along said second set of perforation lines comprises first and second pairs of rollers spaced along said support means for driving said second roller pair faster than said first roller pair, said second roller pair being located downstream of said first roller pair.

7. The apparatus of claim 5 where said sheet moving means comprises said means for separating the labels along said second set of perforation lines.

* * * * *